US010337086B2

(12) United States Patent
Wilks et al.

(10) Patent No.: US 10,337,086 B2
(45) Date of Patent: Jul. 2, 2019

(54) CORRODIBLE DOWNHOLE ARTICLE

(71) Applicant: Magnesium Elektron Limited, Manchester (GB)

(72) Inventors: Timothy E Wilks, Manchester (GB); Mark Turski, Manchester (GB)

(73) Assignee: Magnesium Elektron Limited, Manchester (GB)

( * ) Notice: Subject to any disclaimer, the term of this patent is extended or adjusted under 35 U.S.C. 154(b) by 560 days.

(21) Appl. No.: 14/810,759

(22) Filed: Jul. 28, 2015

(65) Prior Publication Data

US 2016/0024619 A1 Jan. 28, 2016

(30) Foreign Application Priority Data

Jul. 28, 2014 (GB) ..... 1413327.6

(51) Int. Cl.

| | |
|---|---|
| ***C22C 23/00*** | (2006.01) |
| ***B22D 21/04*** | (2006.01) |
| ***C22C 23/02*** | (2006.01) |
| ***C22C 23/06*** | (2006.01) |
| ***C22C 23/04*** | (2006.01) |
| ***E21B 33/12*** | (2006.01) |
| ***E21B 34/06*** | (2006.01) |
| ***B22D 21/00*** | (2006.01) |

(52) U.S. Cl.

CPC ..... *C22C 23/00* (2013.01); *B22D 21/007* (2013.01); *B22D 21/04* (2013.01); *C22C 23/02* (2013.01); *C22C 23/04* (2013.01); *C22C 23/06* (2013.01); *E21B 33/12* (2013.01); *E21B 34/063* (2013.01)

(58) Field of Classification Search

CPC ..... C22C 23/00; C22C 23/02; C22C 23/04; C22C 23/06

See application file for complete search history.

(56) References Cited

U.S. PATENT DOCUMENTS

| | | | |
|---|---|---|---|
| 6,230,799 | B1 | 5/2001 | Slaughter et al. |
| 8,425,651 | B2 | 4/2013 | Xu et al. |
| 9,057,242 | B2 | 6/2015 | Mazyar et al. |
| 9,068,428 | B2 | 6/2015 | Mazyar et al. |
| 9,139,928 | B2 | 9/2015 | Mazyar et al. |
| 9,528,343 | B2 | 12/2016 | Jordan et al. |
| 2002/0102179 | A1† | 8/2002 | Murai et al. |
| 2003/0173005 | A1† | 9/2003 | Higashi et al. |
| 2005/0279427 | A1 | 12/2005 | Park et al. |
| 2008/0175744 | A1 | 7/2008 | MOtegi |
| 2011/0048743 | A1 | 3/2011 | Stafford et al. |
| 2011/0229365 | A1 | 9/2011 | Lyon et al. |
| 2012/0103135 | A1 | 5/2012 | Xu et al. |
| 2012/0156087 | A1† | 6/2012 | Kawabata et al. |
| 2012/0247765 | A1 | 10/2012 | Agrawal et al. |
| 2012/0318513 | A1† | 12/2012 | Mazyar et al. |
| 2013/0029886 | A1 | 1/2013 | Mazyar et al. |
| 2013/0047785 | A1 | 2/2013 | Xu |
| 2013/0112429 | A1† | 5/2013 | Crews |
| 2013/0118759 | A1 | 5/2013 | Crews |
| 2013/0133897 | A1 | 5/2013 | Baihly et al. |
| 2013/0168257 | A1* | 7/2013 | Mazyar ..... C09K 8/54 205/261 |
| 2014/0124216 | A1 | 5/2014 | Fripp et al. |
| 2014/0190705 | A1† | 7/2014 | Fripp et al. |
| 2015/0240337 | A1 | 8/2015 | Sherman et al. |
| 2015/0299838 | A1† | 10/2015 | Doud et al. |
| 2016/0201435 | A1 | 7/2016 | Fripp et al. |
| 2016/0230494 | A1 | 8/2016 | Fripp et al. |
| 2016/0251934 | A1 | 9/2016 | Walton et al. |
| 2016/0265091 | A1 | 9/2016 | Walton et al. |
| 2018/0010217 | A1 | 1/2018 | Wilks et al. |

FOREIGN PATENT DOCUMENTS

| | | | |
|---|---|---|---|
| CN | 101392345 | A | 3/2009 |
| CN | 103343271 | A | 10/2013 |
| CN | 103602865 | A | 2/2014 |
| CN | 103898384 | A | 4/2014 |
| CN | 104152775 | A | 11/2014 |
| CN | 105779796 | A | 7/2016 |
| CN | 106086559 | A | 11/2016 |
| EP | 0400574 | A1 | 12/1990 |
| EP | 0470599 | A1 | 2/1998 |
| EP | 2 088 217 | † | 8/2009 |
| EP | 2088217 | † | 8/2009 |
| EP | 2088217 | A | 8/2009 |
| FR | 2296698 | A1 | 7/1976 |
| GB | 2095288 | A | 9/1982 |
| JP | 09-263871 | A | 7/1997 |
| JP | H10147830 | A | 6/1998 |
| JP | 2008-280565 | A | 11/2008 |

(Continued)

OTHER PUBLICATIONS

Search and Examination Report dated Dec. 7, 2015 for GB1513245.9.

Partial International Search Report for PCT/GB2015/052169 dated Oct. 27, 2015.

Gonzalez S, et al. " Influence of processing route on microstructure and mechanical properties of two Mg Ni Y RE alloys", Materials Characterizations, Elsevier, New York, NY, US, vol. 64, Dec. 1, 2011, pp. 53-61.

Louzguine, D.V., et al. "Influence of Ni, Cu, Zn and Al additions on Glass-Forming Ability and Mechanical Properties of Mg—Y—Mm (Mm=Mischmetal) Alloys", Materials Science Forum, vol. 350-351, Jan. 1, 2000, pp. 123-130.

King, John F., et al., "Influence of rare earth elements and minor additions on properties and performance of magnesium-yttrium alloys in critical aerospace applications", Annual World Magnesium Conference, Proceedings, 59th, Montreal, QC, Canada, May 19-21, Jan. 1, 2002, pp. 15-21.

(Continued)

*Primary Examiner* — Jessee R Roe
*Assistant Examiner* — Jophy S. Koshy
(74) *Attorney, Agent, or Firm* — Abel Schillinger, LLP

(57) ABSTRACT

A magnesium alloy suitable for use as a corrodible downhole article. The alloy has a corrosion rate of at least 50 mg/cm$^2$/day in 15% KCl at 93° C. and a 0.2% proof strength of at least 50 MPa when tested using standard tensile test method ASTM B557-10.

18 Claims, 4 Drawing Sheets

(56) References Cited

FOREIGN PATENT DOCUMENTS

| | | | |
|---|---|---|---|
| KR | 20130023707 | A | 3/2013 |
| WO | WO9856347 | | 12/1998 |
| WO | WO2004001087 | A1 | 12/2003 |
| WO | WO2010038016 | A1 | 4/2010 |
| WO | WO2010110505 | A1 | 9/2010 |
| WO | 2014/035858 | A1 | 3/2014 |
| WO | 2015/127174 | A1 | 8/2015 |
| WO | WO2016032490 | A1 | 3/2016 |

OTHER PUBLICATIONS

Song, G., et al. " Understanding Magnesium Corrosion-A Framework for Improved Alloy Performance", Advanced Engineering Materials, vol. 5, No. 12, Dec. 30, 2003, pp. 837-858.
Zhang, Z., et al. "Synthesis of disintegrable metal composite for oilfield applications" Magnesium Technology (Magnesium Technology 2013—TMS 2013 Annual Meeting and Exhibition Mar. 3, 2013 to Mar. 7, 2013 San Antonio, TX), Jan. 1, 2013, pp. 299-303.
Blawert C et al: "Magnesium secondary alloys: Alloy design for magnesium alloys with improved tolerance limits against impurities", Corrosion Science, Oxford, GB, vol. 52, No. 7, Jul. 1, 2010 (Jul. 1, 2010), pp. 2452-2468.
Wang Hai-Gang et al: "Effect of Ni on microstructures and mechanical properties of AZ1 02 magnesium alloys", Zhuzao Foundry, Shenyang Zhuzao Yanjiusuo, CN, vol. 62, No. 4, Jan. 1, 2013 (Jan. 1, 2013), pp. 315-318.
Kim J-G et al: "Effect of aluminum on the corrosion characteristics of Mg—4Ni—xAl alloys", Corrosion, NACE, vol. 59, No. 3, Jan. 1, 2003 (Jan. 1, 2003), pp. 228-237.
Unsworth William et al: "A new magnesium alloy system", Light Metal Age, Fellom, San Francisco, CA, US, vol. 37, No. 7-8, Jan. 1, 1979 (Jan. 1, 1979), pp. 29-32.
Geng J et al: "Enhanced age-hardening response of Mg—Zn alloys via Co additions", Scripta Materialia, Elsevier, Amsterdam, NL, vol. 64, No. 6, Mar. 1, 2011 (Mar. 1, 2011), pp. 506-509.
Zhu H M et al: "Microstructure and mechanical properties of Mg6ZnCu0.6Zr (wt.%) alloys", Journal of Alloys and Compounds, Elsevier Sequoia, Lausanne, CH, vol. 509, No. 8, Dec. 22, 2010 (Dec. 22, 2010), pp. 3526-3531.
International Search Report for PCT/GB2015/052169 dated Feb. 17, 2016.
Written Opinion of the International Searching Authority for PCT/GB2015/052169 dated Feb. 17, 2016.
Search and Examination Report dated Jan. 21, 2015 for GB1413327.6.
Magnesium Elektron Test Report dated Mar. 8, 2005.
Fishery Management Plan for American Lobster Amendment 3, New England Fishery Management Council, Jul. 1989.
Principles of Magnesium Technology by E. F. Emley, Pergamon Press, Oxford, 1966.
U.S. Appl. No. 15/865,768, filed Jan. 9, 2018, entitled Corrodible Downhole Article, Inventor Timothy E. Wilks, et al.
U.S. Appl. No. 15/865,776, filed Jan. 9, 2018, entitled Corrodible Downhole Article, Inventor Timothy E. Wilks, et al.
Combined Search & Examination Report for GB1700714.7, dated Jun. 15, 2017, 8 pages.
Combined Search & Examination Report for GB1700716.2, dated Jun. 15, 2017, 8 pages.
Combined Search & Examination Report for GB1712249.0, dated Jan. 30, 2018, 6 pages.
International Search Report and Written Opinion for PCT/GB2018/050038, dated Mar. 14, 2018, 14 pages.
International Search Report and Written Opinion for PCT/GB2018/050039, dated Mar. 29, 2018, 11 pages.
ASTM Designation B199-99, "Standard Specification for Magnesium-Alloy Permanent Mold Castings", dated Dec. 1999, pp. 1-6.
Shaw, Barbara A., "Corrosion Resistance of Magnesium Alloys," ASM Handbook, vol. 13A Corrosion:Fundamentals, Testing, and Protection (2003), pp. 692‐696, ASM International.†
Hanawalt et al., "Corrosion Studies of Magnesium and Its Alloys" Metals Technology, Technical Paper 1353,(Presented in Philadelphia in Oct. 1941); Also published in Transactions of the American Institute of Mining and Metallurgical Engineers, vol. 147, Institute of Metals Division, New York, NY, 1942.†
Magnesium Alloys, Casting Source Directory ‐ Engineered Casting Solutions, the American Foundry SocietyTechnical Dept., Schaumburg, Illinois, pp. 41‐43, 2006, available at www.afsinc.org/files/images/magnes.pdf.†
Rokhlin, L.L., Magnesium Alloys Containing Rare Earth Metals Structure and Properties, Advances in MetallicAlloys Series vol. 3, Taylor & Francis, London and New York, 2003.†
Ghali, Edward, Corrosion Resistance of Aluminum and Magnesium Alloys, pp. 382‐389, Wiley Publishing,2010.†
Kim, Sung Gyoo et al., "High Mechanical Strengths of Mg‐ Ni‐Y and Mg‐ Cu‐Y Amorphous Alloys with SignificantSupercooled Liquid Region," Materials Transactions, JIM, vol. 31, No. 11 (1990), pp. 929‐934.†
Tekumalla, Sravya et al., "Mechanical Properties of Magnesium ‐ Rare Earth Alloy Systems: A Review." Metals2015,5, 1‐39, Dec. 2014, ISSN 2075‐4701, doi 10.3390/met5010001.†
"Fabrication and characterisation of pure magnesium-30 vol. % SiCP particle composite" by Saravan et al., Material Science and Eng'g A276 (2000) 108-116.†
"Texture ecolution and mechanical properties of AZ31B magnesium alloy sheets processed by repeated unidirectional bending" by Song et al., Journal of Alloys and Compounds 489 (2010) 475-481.†
Fabrication and characterisation of pure magnesium-30 vol SiCP particle composite by Saravanan et al., Material Science and Eng A276, 2000, 108-116.†
Texture evolution and mechanical properties of AZ31B magnesium alloy sheets processed by repeated unidirectional bending by Song et al, Journal of Alloys and Compounds 489, 2010, 475-481.†

* cited by examiner
† cited by third party

CORRODIBLE DOWNHOLE ARTICLE

This disclosure relates to a magnesium alloy suitable for use as a corrodible downhole article, a method for making such an alloy, an article comprising the alloy and the use of the article.

BACKGROUND

The oil and gas industries utilise a technology known as hydraulic fracturing or "fracking". This normally involves the pressurisation with water of a system of boreholes in oil and/or gas bearing rocks in order to fracture the rocks to release the oil and/or gas.

In order to achieve this pressurisation, valves may be used to separate different sections of a borehole system. These valves are referred to as downhole valves, the word downhole being used in the context of the disclosure to refer to an article that is used in a well or borehole.

One way of forming such valves involves the use of spheres of material known as fracking balls to seal off parts of a borehole. Fracking balls may be made from aluminium, magnesium, polymers or composites.

A problem with the use of fracking balls relates to how they are removed once the fracking operation has been completed in order to allow fluid to flow through the well or borehole. One way of doing this is to drill through the fracking ball. However, this type of drilling process can hamper production, as well as being expensive, difficult and therefore undesirable.

One proposed solution to this problem has been to form the fracking ball from a material that will dissolve or corrode under the conditions in the well or borehole. An issue that needs to be considered in relation to such corrodible articles is ensuring that they corrode at a rate which allows them to remain useable for the time period during which they are required to perform their function, but that allows them to corrode or dissolve afterwards.

Degradable polymers have been used in order to provide a corrodible article for use in such methods. However, these polymers do not generally have particularly high mechanical strength.

An alternative corrodible article is described in U.S. Pat. No. 8,425,651 in the name of Xu et al. This document describes a powder metal composite comprising a nanomatrix, preferably made of Al or Ni or a combination thereof, in which are dispersed a plurality of first particles, a plurality of second particles and a solid-state bond layer. The first particles comprise Mg, Al, Zn or Mn, or a combination thereof, and the second particles comprise carbon nanoparticles. The composite may be produced by forming a powder mixture of the required components and then applying temperature and pressure to the powder to sinter and deform (but not melt) the composite in order to form a powder composite. A problem with such powder metallurgical methods is that they are complicated and expensive.

A further corrodible article is described in US patent application publication no 2012/0318513 in the name of Mazyar et al. In this document, the corrodible article is described as having a corrodible core and a metallic layer covering the core. The core material is described as being a magnesium alloy. However, it appears that the combination of magnesium and one or more other materials in a form which is not an alloy is also intended to be covered by the use of the term "alloy" in Mazyar et al. For example, this document refers to alloys of magnesium with tungsten, whereas it is actually not technically feasible to form a magnesium-tungsten alloy. Similarly, Mazyer et al also mentions powders of magnesium coated with a metal oxide as being useful for forming the core, which again would not be magnesium "alloys". Thus, Mazyar et al appears to utilise the term "magnesium alloy" to mean any way in which magnesium and another metal are combined. The metallic layer is described as including aluminium or nickel.

Although casting, forging and machining are described in Mazyar et al, these are only mentioned in very general terms (e.g., method steps and heating temperatures are not stated) and the structure of the resulting materials is not described. In addition, the preferred method of forming the corrodible article is by compressing the powder into the desired shape, for example by cold compression using an isostatic press. As noted above, such powder metallurgical methods are complicated and expensive. In addition, the resulting powder composites can have poor mechanical properties.

Thus, there is a need in the oil and gas industries to provide a corrodible article which provides the desired corrosion characteristics, whilst also having improved mechanical properties, and at a lower cost than can currently be achieved. It is also advantageous for the corrodible article to have a relatively low density (for example, compared to metals in general). This disclosure seeks to ameliorate these problems and to achieve these effects.

Many features, advantages and a fuller understanding of the disclosure will be had from the accompanying drawings and the Statement of the Disclosure that follows. It should be understood that the following Statement of the Disclosure describes the subject matter of the disclosure and presents specific embodiments that should not be construed as necessary limitations of the broad invention as defined in the claims.

Statement of the Disclosure

This disclosure relates to a magnesium alloy suitable for use as a corrodible downhole article, wherein the alloy has a corrosion rate of at least 50 mg/cm$^2$/day in 15% KCl at 93° C. and a 0.2% proof strength of at least 50 MPa when tested using standard tensile test method ASTM B557-10.

In relation to this disclosure, the term "alloy" is used to mean a composition made by mixing and fusing two or more metallic elements by melting them together, mixing and re-solidifying them.

The term "rare earth metals" is used in relation to the disclosure to refer to the fifteen lanthanide elements, as well as Sc and Y.

The magnesium alloy particularly comprises an element selected from the group consisting of Ni, Co, Ir, Au, Pd, Cu and combinations thereof. In some embodiments, Ni in particular is used. These metallic elements promote the corrosion of the alloy. In all embodiments, the alloy particularly comprises the element selected from the group consisting of Ni, Co, Ir, Au, Pd, Cu and combinations thereof, more particularly Ni, in an amount of between 0.01% and 15% by weight (wt %), and in some embodiments more particularly between 0.1% and 10% by weight, even more particularly between 0.2% by weight and 8% by weight.

Particular combinations of metals in the magnesium alloy include Mg—Al—Zn—Mn, Mg—Al—Mn, Mg—Zn—Zr, Mg—Y—RE-Zr, Mg—Zn—Cu—Mn, Mg—Nd—Gd—Zr, Mg—Ag—RE-Zr, Mg—Zn-RE-Zr, Mg—Gd—Y—Zr, Mg—Al—Ca—Mn and Mg—Al—Sn—Zn—Mn. These additional elements can be included by forming an alloy of magnesium with those elements, and then adding a corrosion promoting metallic element (i.e., an element selected from the group consisting of Ni, Co, Ir, Au, Pd, Cu and combinations thereof) to the molten alloy.

In a first embodiment, the magnesium alloy comprises (a) 0.01-10 wt % of an element selected from the group consisting of Ni, Co, Ir, Au, Pd, Cu and combinations thereof, (b) 1-10 wt % Y, (c) 1-15 wt % of at least one rare earth metal other than Y, and (d) 0-1 wt % Zr.

In the first embodiment, the magnesium alloy comprises at least one rare earth metal other than Y in an amount of 1-15 wt %, more particularly in an amount of 1-10 wt %, even more particularly in an amount of 1.5-5.0 wt %. A particular rare earth metal other than Y is Nd. A particular amount of Nd in the alloy is 1.7-2.5 wt %, more particularly 2.0-2.3 wt %.

In the first embodiment, the magnesium alloy comprises Y in an amount of 1-10 wt %, particularly in an amount of 2.0-6.0 wt %, more particularly in an amount of 3.0-5.0 wt %, even more particularly in an amount of 3.3-4.3 wt % or 3.7-4.3 wt %.

In the first embodiment, the magnesium alloy comprises Zr in an amount of up to 1 wt %. In some embodiments, the magnesium alloy comprises Zr in an amount of 0.05-1.0 wt %, more particularly in an amount of 0.2-1.0 wt %, even more particularly in an amount of 0.3-0.6 wt %. In some embodiments, the magnesium alloy comprises Zr in an amount of up to 0.6 wt %, particularly up to 0.3 wt %, more particularly up to 0.15 wt %. In some embodiments, the magnesium alloy is substantially free of Zr (e.g., the magnesium alloy comprises less than 0.05 wt % Zr).

For all embodiments, for example, the remainder of the alloy is magnesium and incidental impurities. In particular, the content of Mg in the magnesium alloy is at least 80 wt %, more particularly at least 85 wt %, even more particularly at least 87 wt %.

A particular composition of the first embodiment is a magnesium alloy comprising 3.3-4.3 wt % Y, 0.2-1.0 wt % Zr, 2.0-2.5 wt % Nd and optionally 0.3-1.0 wt % other rare earths with Ni as the corrosion promoting metallic element. An alternative composition of the first embodiment is a magnesium alloy comprising 3.3-4.3 wt % Y, up to 0.2 wt % Zr, 1.7-2.5 wt % Nd and optionally 0.3-1.0 wt % other rare earths with Ni as the corrosion promoting metallic element.

In the first embodiment, the magnesium alloy particularly comprises Ni in an amount of between 0.01% and 10% by weight, more particularly between 0.1% and 8% by weight, even more particularly between 0.2% by weight and 7% by weight. A further particular composition is a magnesium alloy comprising 3.3-4.3 wt % Y, 0.2-1.0 wt % Zr, 2.0-2.5 wt % Nd and 0.2-7 wt % Ni. An alternative further particular composition is a magnesium alloy comprising 3.3-4.3 wt % Y, not more than 0.2 wt % Zr, 1.7-2.5 wt % Nd and 0.2-7 wt % Ni. In particular, the remainder of the alloy is magnesium and incidental impurities.

In another particular aspect of the first embodiment, the magnesium alloy comprises one or more rare earth metals, preferably in an amount of 0.1-15 wt %, more preferably in an amount of 0.1-5 wt %, even more preferably in an amount of 0.3-1.0 wt %.

In some embodiments, the magnesium alloy comprises Y in an amount of up to 8 wt %, preferably in an amount of 2.0-6.0 wt %, more preferably in an amount of 3.5-4.5 wt %, even more preferably in an amount of 3.7-4.3 wt %.

In some embodiments, the magnesium alloy comprises Zr in an amount of up to 1 wt %, preferably in an amount of 0.05-1.0 wt %, more preferably in an amount of 0.2-1.0 wt %. In some embodiments, the magnesium alloy is substantially free of Zr (eg the magnesium alloy comprises less than 0.05 wt % Zr).

The corrosion promoting metallic element is preferably one or more of Ni, Co, Ir, Au, Pd or Cu. In some embodiments, Ni is preferred. The alloy preferably comprises the corrosion promoting metallic element in an amount of between 0.01% and 10% by weight, more preferably between 0.01% and 5% by weight, even more preferably between 0.01% by weight and 2% by weight.

A particularly preferred combination is a magnesium alloy comprising 3.7-4.3 wt % Y, 0.2-1.0 wt % Zr, 2.0-2.5 wt % Nd and 0.3-1.0 wt % rare earths with Ni as the corrosion promoting metallic element. In this alloy, Ni is preferably in an amount of between 0.01% and 5% by weight, more preferably between 0.01% by weight and 2% by weight. It is preferred that the remainder of the alloy is magnesium and incidental impurities.

A preferred magnesium alloy comprises up to 8 wt % Y, up to 8 wt % rare earths and up to 1 wt % Zr. A particularly preferred magnesium alloy comprises 3.7-4.3 wt % Y, up to 1 wt % Zr, 2.0-2.5 wt % Nd and 0.3-1.0 wt % rare earths. In this alloy, Zr may be present in an amount of 0.2-1.0 wt %, or the alloy may comprise less than 0.05 wt % Zr. Also in this alloy, Ni is preferably present in an amount of between 0.01% and 1% by weight. It is preferred that the remainder of the alloy is magnesium and incidental impurities.

In a second embodiment, the magnesium alloy comprises (a) 0.01-10 wt % of an element selected from the group consisting of Ni, Co, Ir, Au, Pd, Cu and combinations thereof, (b) 1-15 wt % Al, (c) 0.1-1 wt % Mn, and (d) optionally at least one of Ca, Sn and Zn.

In the second embodiment, the magnesium alloy comprises 1-15 wt % Al, particularly 2-12 wt % Al, more particularly 2.5-10 wt % Al.

In the second embodiment, the magnesium alloy comprises 0.1-1 wt % Mn, particularly 0.1-0.8 wt % Mn, more particularly 0.2-0.6 wt % Mn.

In the second embodiment, the magnesium alloy optionally comprises at least one of Ca, Sn and Zn. When the alloy comprises Sn, it is particularly in an amount of 2-6 wt %, more particularly 3-5 wt %. When the alloy comprises Zn, it is particularly in an amount of 0.1-3 wt %, more particularly 0.2-2.5 wt %. In some embodiments, the alloy comprises both Sn and Zn. When the alloy comprises Ca, it is particularly in an amount of 1-10 wt %, more particularly 2-6 wt %.

In the second embodiment, in particular the magnesium alloy comprises Ni in an amount of between 0.01% and 10% by weight, more particularly between 0.01% and 5% by weight, even more particularly between 0.1% by weight and 3% by weight.

In a third embodiment, the magnesium alloy comprises (a) 0.01-15 wt % of an element selected from the group consisting of Ni, Co, Ir, Au, Pd, Cu and combinations thereof, (b) 1-9 wt % Zn, and (c) optionally at least one of Mn and Zr.

In the third embodiment, the magnesium alloy comprises 1-9 wt % Zn, particularly 5-8 wt % Zn, more particularly 6-7 wt % Zn.

In the third embodiment, when the alloy comprises Mn it is particularly in an amount of 0.1-1 wt %, more particularly 0.5-1.0 wt %, even more particularly 0.7-0.9 wt %.

In the third embodiment, the magnesium alloy particularly comprises Ni in an amount of between 0.01% and 10% by weight, more particularly between 0.01% and 7% by weight, even more particularly between 0.1% by weight and 5% by weight.

In the third embodiment, the magnesium alloy may also comprise Cu, particularly in an amount of 0.1-5 wt %, more particularly 0.5-3 wt %, even more particularly 1-2 wt %. In some embodiments, the alloy comprises both Mn and Cu.

In the third embodiment, when the magnesium alloy comprises Zr it is particularly in an amount of up to 1 wt %, more particularly in an amount of 0.05-1.0 wt %, even more particularly in an amount of 0.2-1.0 wt %, more particularly in an amount of 0.3-0.7 wt %.

In particular the corrosion promoting metallic element (i.e., an element selected from the group consisting of Ni, Co, Ir, Au, Pd, Cu and combinations thereof) has a solubility of at least 0.1% by weight in molten magnesium at 850° C. More specifically, the corrosion promoting metallic element has a solubility of at least 0.5% by weight in molten magnesium at 850° C., more particularly at least 1% by weight. In some embodiments, in particular, the corrosion promoting metallic element has a solubility of at least 1% by weight in the molten magnesium alloy to which it is to be added at 850° C. In relation to the molten material, the term "solubility" is used to mean that the corrosion promoting metallic element dissolves in the molten magnesium or magnesium alloy.

More specifically, the corrosion promoting metallic element has a solubility of less than 0.1% by weight, more particularly less than 0.01% by weight, in solid magnesium at 25° C. In some embodiments, in particular the corrosion promoting metallic element has a solubility of less than 0.1% by weight, more particularly less than 0.01% by weight, in the solid magnesium alloy to which it is to be added at 25° C. In relation to the solid material, the term "solubility" is used to mean that atoms of the corrosion promoting metallic element are randomly distributed throughout the alloy in a single phase (i.e., rather than forming a separate phase).

More specifically, the magnesium alloy has a corrosion rate of at least 50 $mg/cm^2/day$, particularly at least 75 $mg/cm^2/day$, even more particularly at least 100 $mg/cm^2/day$, in 3% KCl at 38° C. (100° F.). In particular the magnesium alloy has a corrosion rate of at least 75 $mg/cm^2/day$, particularly at least 250 $mg/cm^2/day$, even more particularly at least 500 $mg/cm^2/day$, in 15% KCl at 93° C. (200° F.). In particular the corrosion rate, in 3% KCl at 38° C. or in 15% KCl at 93° C. (200° F.), is less than 15,000 $mg/cm^2/day$.

In particular the magnesium alloy has a 0.2% proof strength of at least 75 MPa, more particularly at least 100 MPa, even more particularly at least 150 MPa, when tested using standard tensile test method ASTM B557-10. In particular the 0.2% proof strength is less than 700 MPa. The proof strength of a material is the stress at which material strain changes from elastic deformation to plastic deformation, causing the material to deform permanently.

In particular the 0.2% proof strength of the magnesium alloy when the element selected from the group consisting of Ni, Co, Ir, Au, Pd, Cu and combinations thereof has been added is at least 80%, more particularly at least 90%, of the 0.2% proof strength of the base alloy. The term "base alloy" is used to mean the magnesium alloy without the element selected from the group consisting of Ni, Co, Ir, Au, Pd, Cu and combinations thereof, having been added. Even more particularly, the 0.2% proof strength of the magnesium alloy when Ni has been added is at least 80%, more particularly at least 90%, of the 0.2% proof strength of the base alloy.

This disclosure also relates to a corrodible downhole article, such as a downhole tool, comprising the magnesium alloy described above. For example, the corrodible downhole article can be a fracking ball, plug, packer or tool assembly. More specifically, the fracking ball can be substantially spherical in shape. In some embodiments, the fracking ball consists essentially of the magnesium alloy described above.

This disclosure also relates to a method for producing a magnesium alloy suitable for use as a corrodible downhole article comprising the steps of:

(a) melting magnesium or the magnesium alloy described above, (b) adding the element selected from the group consisting of Ni, Co, Ir, Au, Pd, Cu and combinations thereof to the molten magnesium or magnesium alloy such that the element selected from the group consisting of Ni, Co, Ir, Au, Pd, Cu and combinations thereof melts, (c) mixing the resulting molten magnesium alloy, and (d) casting the magnesium alloy.

In particular the method is for producing a magnesium alloy as defined above. In particular the melting step is carried out at a temperature of 650° C. (i.e., the melting point of pure magnesium) or more, particularly less than 1090° C. (the boiling point of pure magnesium). A particular temperature range is 650° C. to 850° C., more particularly 700° C. to 800° C., most specifically about 750° C.

The casting step normally involves pouring the molten magnesium alloy into a mould, and then allowing it to cool and solidify. The mould may be a die mould, a permanent mould, a sand mould, an investment mould, a direct chill casting (DC) mould, or other mould.

After step (c), the method may comprise one or more of the following additional steps: (d) extruding, (e) forging, (f) rolling, (g) machining.

In particular step (a) comprises melting the magnesium alloy described above. Specifically the magnesium alloy of step (a) comprises an element selected from the group consisting of Al, Zn, Mn, Zr, Y, rare earth metals, Cu, Nd, Gd, Ca, Sn, Ag and combinations thereof. Particular magnesium alloys for step (a) are selected from the group consisting of Mg—Al—Zn—Mn, Mg—Al—Mn, Mg—Zn—Zr, Mg—Y—RE-Zr, Mg—Zn—Cu—Mn, Mg—Nd—Gd—Zr, Mg—Ag—RE-Zr, Mg—Zn—RE-Zr, Mg—Gd—Y—Zr, Mg—Al— Ca—Mn and Mg—Al—Sn—Zn—Mn. As noted above, these additional elements can be included by forming an alloy of magnesium with those elements, and then adding the corrosion promoting metallic element to the molten alloy.

In a first particular embodiment, the magnesium alloy comprises 1-10 wt % Y, 1-15 wt % rare earths other than Y and up to 1 wt % Zr. A particular magnesium alloy comprises 3.3-4.3 wt % Y, up to 1 wt % Zr, 2.0-2.5 wt % Nd and optionally 0.3-1.0 wt % rare earths. In this alloy, Zr may be present in an amount of 0.05-1.0 wt %, or the alloy may comprise less than 0.05 wt % Zr. In particular Ni is added in an amount of between 0.2% and 7% by weight. In particular the remainder of the alloy is magnesium and incidental impurities.

In a second particular embodiment, the magnesium alloy comprises 1-15 wt % Al and up to 2 wt % in total of Zn and/or Mn. The alloy particularly comprises 2-12 wt % Al. In particular, the alloy comprises 0.2-1.2 wt % in total of Zn and/or Mn. In particular Ni is added in an amount of 0.1-3 wt %.

In a third particular embodiment, the magnesium alloy comprises 1-9 wt % Zn and optionally at least one of Mn and Zr. The alloy particularly comprises 5-8 wt % Zn. In particular Ni is added in an amount of 0.1-5 wt %.

In particular the corrosion promoting metallic element (ie Ni, Co, Ir, Au, Pd and/or Cu) has a solubility of at least 0.1% by weight in molten magnesium at 850° C. Particularly, the corrosion promoting metallic element has a solubility of at least 0.5% by weight in molten magnesium at 850° C., more particularly at least 1% by weight. In some embodiments, in particular the corrosion promoting metallic element has a solubility of at least 1% by weight in the molten magnesium or magnesium alloy to which it is added.

More specifically the corrosion promoting metallic element (i.e., an element selected from the group consisting of Ni, Co, Ir, Au, Pd, Cu and combinations thereof) has a solubility of less than 0.1% by weight, more particularly less than 0.01% by weight, in solid magnesium at 25° C. In some embodiments, in particular the corrosion promoting metallic element has a solubility of less than 0.1% by weight, more particularly less than 0.01% by weight, in the molten magnesium or magnesium alloy to which it is added once it has been cooled to 25° C. and solidified.

The corrosion promoting metallic element is selected from the group consisting of Ni, Co, Ir, Au, Pd, Cu and combinations thereof. In some embodiments, Ni in particular is used. In relation to compositions of the first particular embodiment, the corrosion promoting metallic element is particularly added in an amount of between 0.01% and 10% by weight, more particularly between 0.1% and 8% by weight, even more particularly between 0.2% and 7% by weight. In relation to compositions of the second particular embodiment, the corrosion promoting metallic element is particularly added in an amount of between 0.01% and 15% by weight, more particularly between 0.01% and 5% by weight, even more particularly between 0.1% and 3% by weight. In relation to compositions of the third particular embodiment, the corrosion promoting metallic element is particularly added in an amount of between 0.01% and 10% by weight, more particularly 0.01% and 7% by weight, even more particularly between 0.1% and 5% by weight.

A particular first embodiment method comprises melting in step (a) a magnesium alloy comprising 3.3-4.3 wt % Y, 0.2-1.0 wt % Zr, 2.0-2.5 wt % Nd and optionally 0.3-1.0 wt % rare earths, and adding in step (b) Ni as the corrosion promoting metallic element. In particular in step (b) Ni is added in an amount of between 0.01% and 10% by weight, more particularly between 0.1% by weight and 8% by weight.

This disclosure also relates to a magnesium alloy suitable for use as a corrodible downhole article which is obtainable by the method described above.

In addition, this disclosure relates to a magnesium alloy as described above for use as a corrodible downhole article.

In all aspects of the first and third embodiments, including the first and third particular embodiments, the magnesium alloy has a desired corrosion rate in 15% KCl at 93° C. selected from the group consisting of: 50-100 mg/cm$^2$/day; 100-250 mg/cm$^2$/day; 250-500 mg/cm$^2$/day; 500-1000 mg/cm$^2$/day; 1000-3000 mg/cm$^2$/day; 3000-4000 mg/cm$^2$/day; 4000-5000 mg/cm$^2$/day; 5000-10,000 mg/cm$^2$/day; 10,000-15,000 mg/cm$^2$/day and combinations thereof.

The method of the disclosure pertaining to the first and third embodiments, including the first and third particular embodiments, comprises tailoring compositions of the magnesium alloys such that the cast magnesium alloys achieve desired corrosion rates in 15% KCl at 93° C. falling in at least two of the following ranges: 50 to 100 mg/cm$^2$/day; 100-250 mg/cm$^2$/day; 250-500 mg/cm$^2$/day; 500-1000 mg/cm$^2$/day; 1000-3000 mg/cm$^2$/day; 3000-4000 mg/cm$^2$/day; 4000-5000 mg/cm$^2$/day; 5000-10,000 mg/cm$^2$/day; and 10,000-15,000 mg/cm$^2$/day.

This disclosure also relates to a method of hydraulic fracturing comprising the use of a corrodible downhole article comprising the magnesium alloy as described above, or a downhole tool as described above. Particularly, the method comprises forming an at least partial seal in a borehole with the corrodible downhole article and then removing the at least partial seal by permitting the corrodible downhole article to corrode. This corrosion can occur at a desired rate with certain alloy compositions of the disclosure as discussed above in connection with the magnesium alloy of the first and third embodiments. More specifically, the corrodible downhole article can be a fracking ball, plug, packer or tool assembly. In particular, the fracking ball can be substantially spherical in shape. In some embodiments, the fracking ball consists essentially of the magnesium alloy described above.

BRIEF DESCRIPTION OF THE DRAWINGS

This disclosure will be further described by reference to the following Figures which is not intended to limit the scope of the claimed subject matter, in which:

EXAMPLES

Example 1—Magnesium Aluminium Alloy

A base magnesium alloy consisting of the commercial alloy AZ80A which has a typical chemical composition of 8.5 wt % Al, 0.5 wt % Zn and 0.3 wt % Mn, was melted by heating to 750° C. and nickel was added to it in amounts ranging between 0.01% wt to 1% wt. The product was then cast into a billet and extruded into a rod.

In order to simulate the mild and extreme corrosion performance in a well, the material was corrosion tested by measuring weight loss in an aqueous solution of 3 wt % potassium chloride at a constant temperature of 38° C. (100° F.) and 15 wt % potassium chloride aqueous solution at a constant temperature of 93° C. (200° F.).

The corrosion rates are shown in Table 1 below. The samples comprise the standard alloy (ie AZ80A without nickel added), and two samples with different amounts of nickel added.

TABLE 1

| Sample ID | Nickel concentration Wt % | Corrosion rate in 3% KCL at 38° C. (100° F.) Mg/cm$^2$/day | Corrosion rate in 15% KCL at 93° C. (200° F.) Mg/cm$^2$/day |
|---|---|---|---|
| Standard alloy | <0.005 | <0.5 | <0.5 |
| DF9905B | 0.016 | 113 | 449 |
| DF9905D | 0.61 | 161 | 1328 |

The data in Table 1 clearly shows the increased corrosion level achieved in the samples to which nickel has been added, with a higher nickel content resulting in a higher corrosion rate.

The mechanical properties of the samples were also tested using standardised tension tests (ie ASTM B557-10), and the results are shown in Table 2 below.

TABLE 2

| Sample ID | Nickel concentration Wt % | 0.2% Proof Strength MPa | UTS MPa | Elongation % |
|---|---|---|---|---|
| Standard alloy | <0.005 | 219 | 339 | 9 |
| DF9905B | 0.016 | 238 | 334 | 11 |
| DF9905D | 0.61 | 219 | 309 | 14 |

Figure 1:
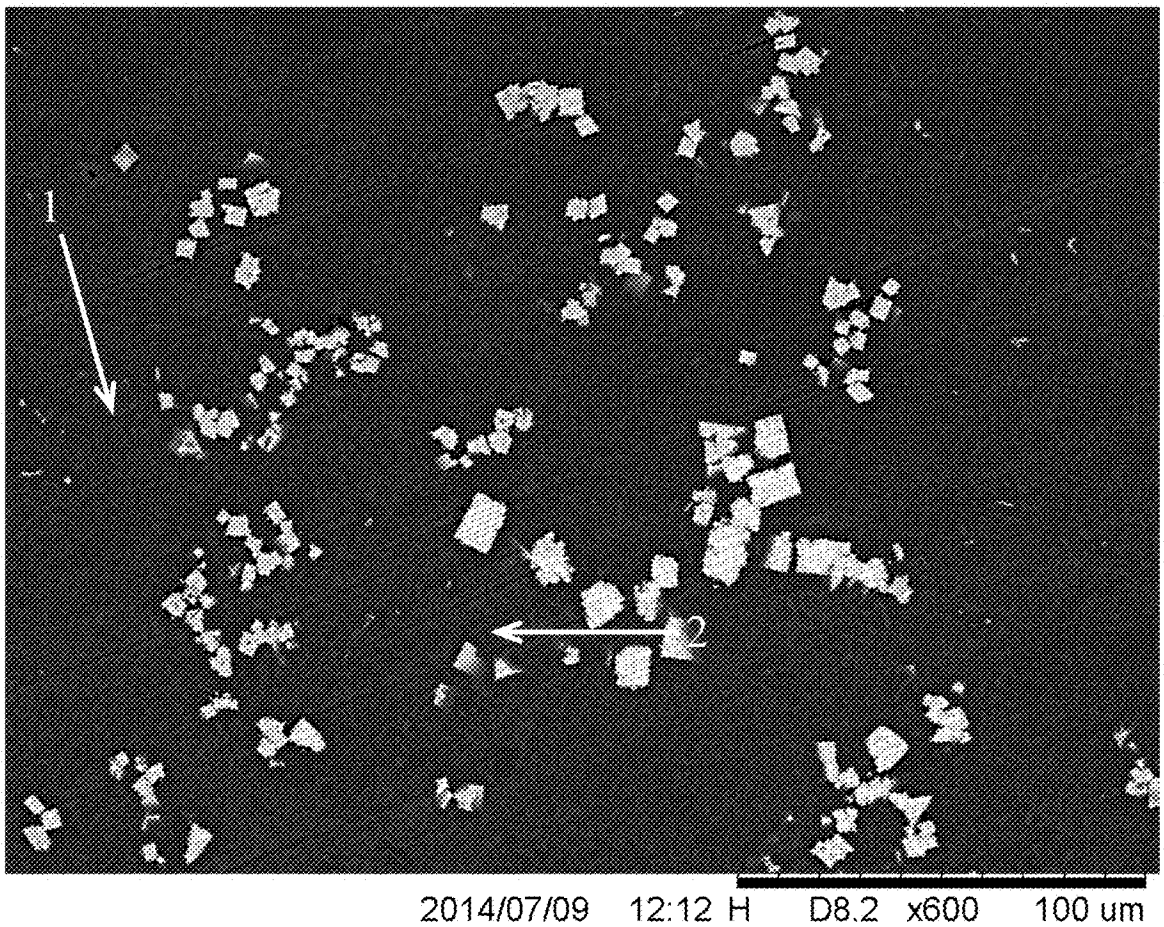
FIG. 1 shows a microstructure of sample DF9905D of Example 1.

FIG. 1 shows a microstructure of sample DF9905D (i.e., 0.61 wt % nickel). The dark area of the microstructure, labelled "1", is the α-Mg phase (i.e., the phase comprising magnesium in solid solution with the other alloying elements). The light area of the microstructure, an example of which is labelled "2", is the phase comprising the corrosion promoting element (i.e., nickel in this case) and magnesium.

Example 2—Magnesium Yttrium Rare Earth Alloy

The procedure of Example 1 was repeated, but with the base magnesium alloy AZ80A being replaced by commercial alloy Elektron 43. A WE43C alloy was used with a composition of 3.7-4.3 wt % Y, 0.2-1.0 wt % Zr, 2.0-2.5 wt % Nd and 0.3-1.0 wt % rare earths.

The corrosion rates are shown in Table 3 below. The samples comprise the standard alloy (i.e., WE43C without nickel added), and five samples with different amounts of nickel added.

TABLE 3

| Sample ID | Nickel concentration Wt % | Corrosion rate in 3% KCl at 38° C. (100° F.) $Mg/cm^2/day$ | Corrosion rate in 15% KCl at 93° C. (200° F.) $Mg/cm^2/day$ |
|---|---|---|---|
| Standard alloy | <0.005 | <0.5 | <0.5 |
| DF9911D | 0.1 | <0.5 | 94 |
| DF9912A | 0.2 | 78 | 308 |
| DF9912B | 0.4 | 199 | 643 |
| DF9912C | 0.62 | 203 | 929 |
| DF9915C | 0.65 | 302 | 1075 |
| DF9915D | 1.43 | 542 | 1811 |

The data in Table 3 clearly shows the increased corrosion level achieved in the samples to which nickel has been added, with a higher nickel content resulting in a higher corrosion rate.

The mechanical properties of these samples were also tested using standardised tension tests, and the results are shown in Table 4 below.

TABLE 4

| Sample ID | Nickel concentration Wt % | 0.2% Proof Strength MPa | UTS MPa | Elongation % |
|---|---|---|---|---|
| Standard alloy | <0.005 | 186 | 301 | 15 |
| DF9911D | 0.1 | 197 | 302 | 17 |
| DF9912A | 0.2 | 234 | 337 | 15 |
| DF9912B | 0.4 | 238 | 331 | 14 |

TABLE 4-continued

| Sample ID | Nickel concentration Wt % | 0.2% Proof Strength MPa | UTS MPa | Elongation % |
|---|---|---|---|---|
| DF9912C | 0.62 | 230 | 311 | 11 |
| DF9915C | 0.65 | 224 | 305 | 21 |
| DF9915D | 1.43 | 229 | 321 | 20 |

The data in Table 4 shows that alloys of the disclosure have improved mechanical properties, in particular 0.2% proof strength, when compared to prior art compositions.

Example 3A—Magnesium Aluminium Alloys

Further magnesium alloy compositions were prepared by combining the components in the amounts listed in Table 5 below (the balance being magnesium). These compositions were then melted by heating at 750° C. The product was then cast into a billet and extruded to a rod.

TABLE 5

| Mg—Al | Alloy Additions (wt %, balance magnesium) | | | | | |
|---|---|---|---|---|---|---|
| Sample ID | Al | Ca | Sn | Zn | Mn | Ni |
| A1 | 8.4 | | | 0.4 | 0.2 | 0.00 |
| A2 | 8.4 | | | 0.4 | 0.2 | 0.02 |
| A3 | 8.4 | | | 0.4 | 0.2 | 0.15 |
| A4 | 8.4 | | | 0.4 | 0.2 | 1.50 |
| A5 | 6.5 | | | 0.7 | 0.3 | 0.00 |
| A6 | 6.5 | | | 0.7 | 0.3 | 0.05 |
| A7 | 6.5 | | | 0.7 | 0.3 | 0.15 |
| A8 | 6.5 | | | 0.7 | 0.3 | 0.30 |
| A9 | 6.5 | | | 0.7 | 0.3 | 0.60 |
| A10 | 6.5 | | | 0.7 | 0.3 | 1.20 |
| A11 | 3.0 | | | 0.7 | 0.3 | 0.00 |
| A12 | 3.0 | | | 0.7 | 0.3 | 0.05 |
| A13 | 3.0 | | | 0.7 | 0.3 | 0.15 |
| A14 | 3.0 | | | 0.7 | 0.3 | 0.30 |
| A15 | 3.0 | | | 0.7 | 0.3 | 0.60 |
| A16 | 3.0 | | | 0.7 | 0.3 | 1.20 |
| A17 | 3.5 | 3.0 | | 0.0 | 0.3 | 0.00 |
| A18 | 4.0 | 5.0 | | 0.0 | 0.5 | 0.15 |
| A19 | 4.0 | 3.6 | | 0.0 | 0.4 | 0.50 |
| A20 | 3.5 | 3.0 | | 0.0 | 0.3 | 2.00 |
| A21 | 8.0 | | 4.0 | 2.0 | 0.3 | 0.00 |
| A22 | 8.0 | | 4.0 | 2.0 | 0.3 | 0.15 |

The mechanical properties of these samples were also tested using the same standardised tension tests, and the results are shown in Table 6 below.

TABLE 6

| Alloy class: Mg—Al | | | |
|---|---|---|---|
| Sample ID | 0.2% Proof Strength (MPa) | Percentage Proof Strength remaining (%) | Corrosion Rate in 15% KCl at 93° C. (200° F.) $(mg/cm^2/day)$ |
| A1 | 219 | 100 | 0 |
| A2 | 239 | 109 | 449 |
| A3 | 235 | 107 | 1995 |
| A4 | 220 | 101 | 1328 |
| A5 | 199 | 100 | 0 |
| A6 | 197 | 99 | 2078 |
| A7 | 203 | 102 | 2531 |
| A8 | 198 | 99 | 2800 |
| A9 | 197 | 99 | 2574 |
| A10 | 199 | 100 | 2494 |
| A11 | 211 | 100 | 0 |
| A12 | 196 | 93 | 1483 |
| A13 | 192 | 91 | 1853 |

TABLE 6-continued

| Alloy class: Mg—Al | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| A14 | 194 | 92 | 1854 |
| A15 | 197 | 94 | 1969 |
| A16 | 194 | 92 | 1877 |
| A17 | 321 | 100 | 0 |
| A18 | 329 | 102 | 3299 |
| A19 | 312 | 97 | 4851 |
| A20 | 309 | 96 | 2828 |
| A21 | 258 | 100 | 0 |
| A22 | 256 | 99 | 1205 |

This data shows that the addition of nickel to these magnesium-aluminium alloys significantly increases the corrosion rate of the alloys. Advantageously, for these alloys this increase in corrosion rate is provided whilst maintaining the mechanical properties of the alloy (as exemplified by the 0.2% proof strength). Thus, the alloys tested in this example can find use as components in downhole tools due to their combination of high corrosion rates and good mechanical properties.

Example 3B—Magnesium Yttrium Rare Earth Alloys

Further magnesium alloy compositions were prepared by combining the components in the amounts listed in Table 7 below. These compositions were then melted by heating at 750° C. The product was then cast into a billet and extruded to a rod.

TABLE 7

| Mg—Y-RE | Alloy Additions (wt %, balance Mg) | | | |
|---|---|---|---|---|
| Sample ID | Y | Nd | Zr | Ni |
| R1 | 4.0 | 2.2 | 0.5 | 0.0 |
| R2 | 3.6 | 2.1 | 0.5 | 0.4 |
| R3 | 3.6 | 2.1 | 0.5 | 0.6 |
| R4 | 3.6 | 2.1 | 0.5 | 1.4 |
| R5 | 3.5 | 2.1 | 0.4 | 1.8 |
| R6 | 3.5 | 2.1 | 0.4 | 3.5 |
| R7 | 3.5 | 2.1 | 0.4 | 5.0 |
| R8 | 3.5 | 2.1 | 0.4 | 6.1 |
| R9 | 3.7 | 2.1 | 0.0 | 0.4 |
| R10 | 3.7 | 2.1 | 0.0 | 0.6 |
| R11 | 3.6 | 2.1 | 0.1 | 1.5 |
| R12 | 3.9 | 2.0 | 0.0 | 1.1 |
| R13 | 3.5 | 1.8 | 0.0 | 2.2 |

The mechanical properties of these samples were tested using standardised tension tests, and the results are shown in Table 8 below.

TABLE 8

| Alloy Class: Mg—Y-RE | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| R1 | 241 | 100 | 0.0 |
| R2 | 229 | 95 | 198.6 |
| R3 | 235 | 97 | 578.5 |

TABLE 8-continued

| Alloy Class: Mg—Y-RE | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| R4 | 234 | 97 | 1302.3 |
| R5 | 238 | 99 | 2160.0 |
| R6 | 263 | 109 | 6060.8 |
| R7 | 253 | 105 | 7175.7 |
| R8 | 232 | 96 | 7793.1 |
| R9 | 221 | 92 | 636.0 |
| R10 | 217 | 90 | 937.0 |
| R11 | 206 | 85 | 1115.0 |
| R12 | 209 | 87 | 1118.0 |
| R13 | 256 | 106 | 3401.0 |

This data shows that, as for the magnesium-aluminium alloys, the addition of nickel to these magnesium-yttrium-rare earth alloys significantly increases the corrosion rate of the alloy. Advantageously, for these alloys this increase in corrosion rate is provided whilst maintaining the mechanical properties of the alloy (as exemplified by the 0.2% proof strength). However, in addition to these advantageous properties, for these alloys the increase in corrosion rate is substantially proportional to the amount of added nickel. This can provide the further feature that the corrosion rate of these alloys is therefore "tunable" and alloys with specific desirable corrosion rates, or ranges of particular corrosion rates, can be produced. Thus, the alloys tested in this example can find use as components in downhole tools due to their combination of high corrosion rates and good mechanical properties.

Example 3C—Magnesium Zinc Alloys

Magnesium alloy compositions were prepared by combining the components in the amounts listed in Table 9 below. These compositions were then melted by heating at 750° C. The product was then cast into a billet and extruded to a rod.

TABLE 9

| Mg—Zn | Alloy Additions (wt %, balance Mg) | | | | |
|---|---|---|---|---|---|
| Sample ID | Zn | Cu | Mn | Zr | Ni |
| Z1 | 6.5 | 1.5 | 0.8 | | 0.00 |
| Z2 | 6.5 | 1.5 | 0.8 | | 1.00 |
| Z3 | 6.5 | 1.5 | 0.8 | | 2.00 |
| Z4 | 6.5 | 1.5 | 0.8 | | 4.00 |
| Z5 | 6.5 | | | 0.5 | 0.00 |
| Z6 | 6.5 | | | | 0.15 |
| Z7 | 6.5 | | | | 0.30 |
| Z8 | 6.5 | | | | 1.00 |

The mechanical properties of these samples were tested using standardised tension tests, and the results are shown in Table 10 below.

TABLE 10

| Alloy Class: Mg—Zn | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| Z1 | 312 | 100 | 50 |
| Z2 | 229 | 73 | 315 |
| Z3 | 229 | 73 | 5474 |
| Z4 | 216 | 69 | 9312 |
| Z5 | 223 | 100 | 1 |
| Z6 | 133 | 59 | 565 |
| Z7 | 137 | 62 | 643 |
| Z8 | 142 | 63 | 905 |

This data shows that, as for the magnesium-aluminium and magnesium-yttrium-rare earth alloys, the addition of nickel to these magnesium-alloys advantageously significantly increases their corrosion rate. Magnesium-zinc alloys are known in the art to have high strength values and it is shown in the disclosure that the addition of nickel also increases their corrosion rate. However, the data demonstrates that the mechanical properties of these Magnesium-zinc alloys (as exemplified by the 0.2% proof strength) decrease with increasing nickel content.

This example shows that not all magnesium alloys provide the mechanical strength required for certain uses of the disclosure when nickel is added to them, and that it is in fact difficult to predict how the properties of a particular alloy will be altered when a corrosion promoting element such as nickel is added.

Figure 2:
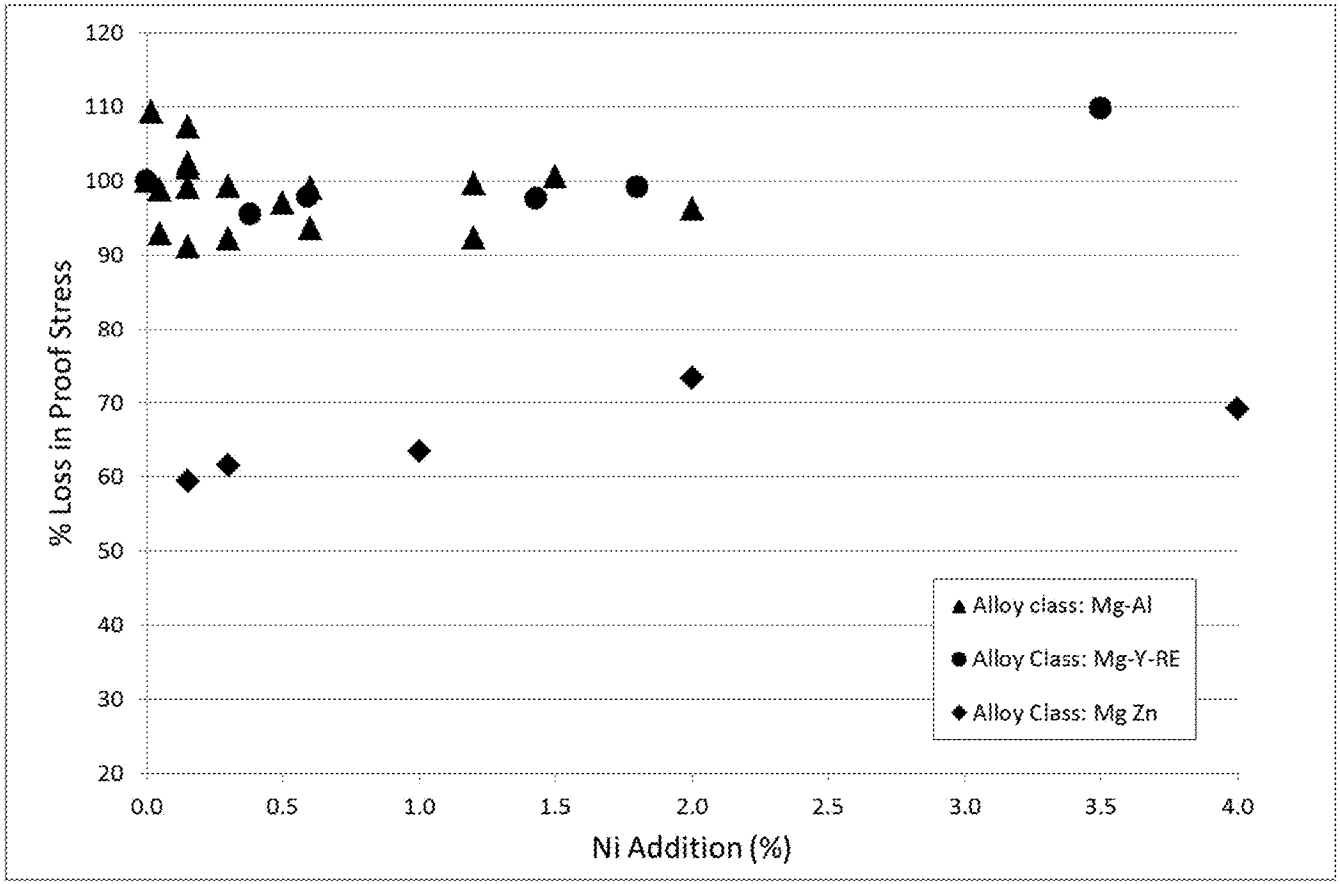
FIG. 2 shows a graph of % loss in proof stress against Ni addition (wt %) for the alloys of Examples 3A, 3B and 3C.
Figure 3:
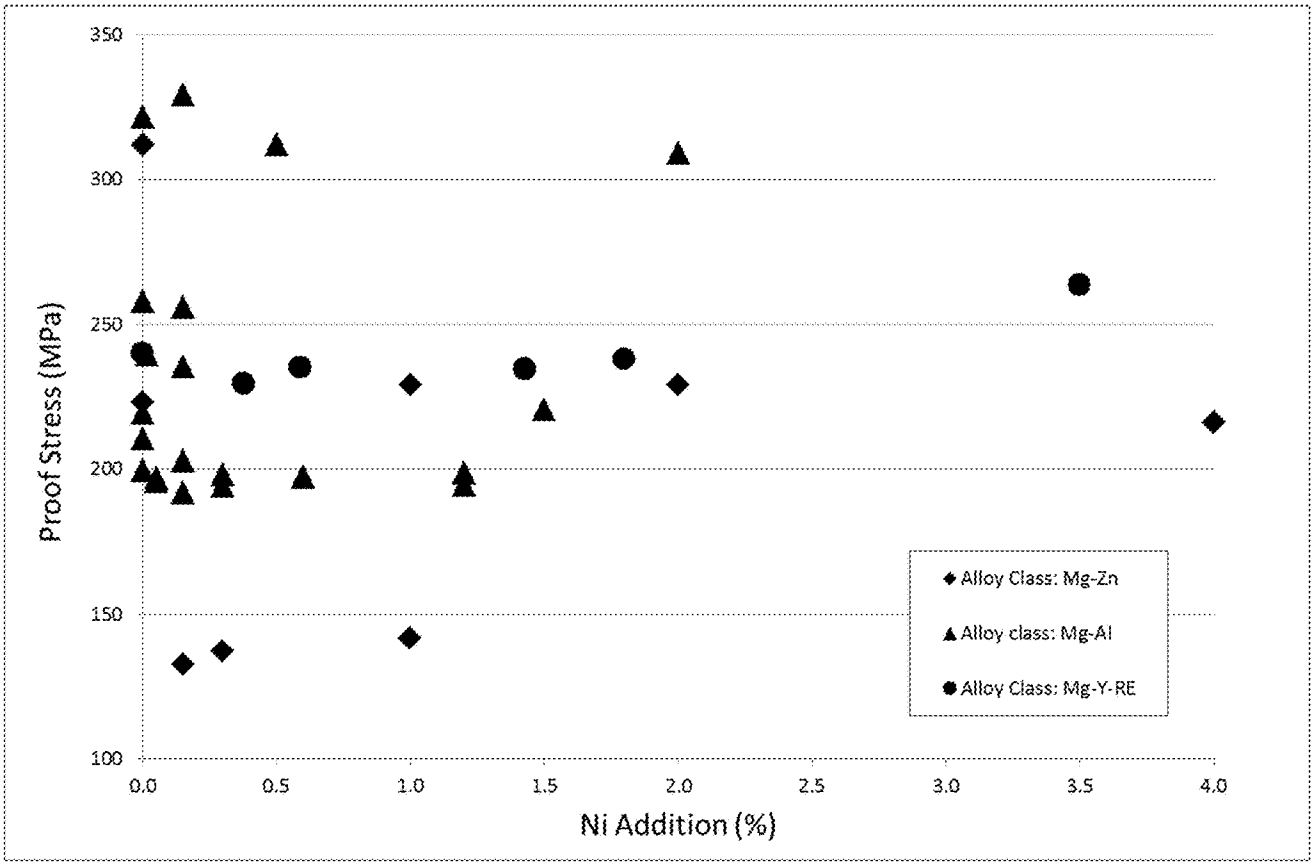
FIG. 3 shows a graph of proof stress against Ni addition (wt %) for the alloys of Examples 3A, 3B and 3C.
Figure 4:
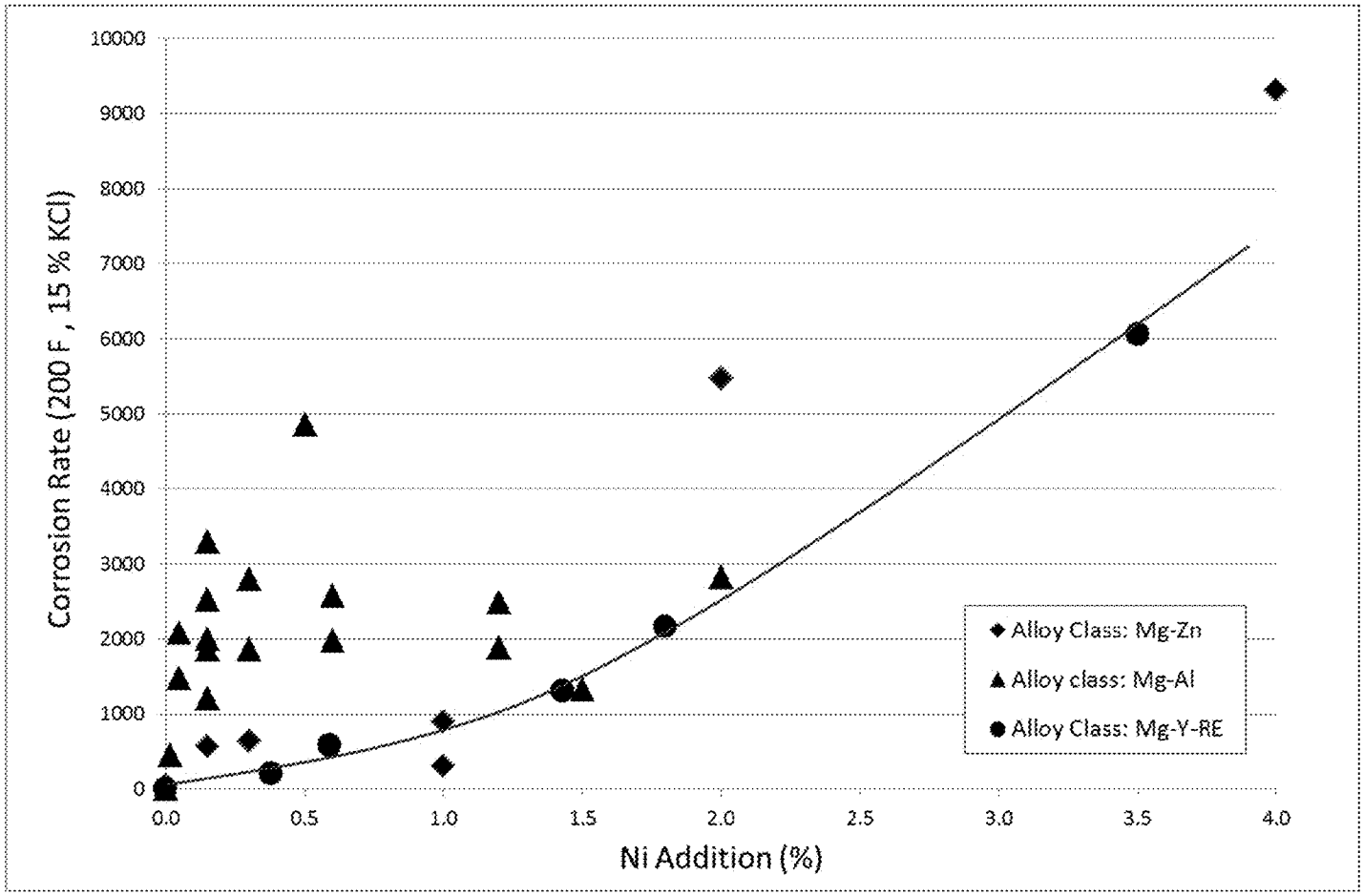
FIG. 4 shows a graph of corrosion rate against Ni addition (wt %) for the alloys of Examples 3A, 3B and 3C.

In FIGS. 2, 3 and 4 the mechanical properties of the alloys of Examples 3A, 3B and 3C, have been plotted against the Ni addition (wt %).

FIG. 2 in particular shows that for the magnesium-zinc alloys of Example 3C ("Mg—Zn", where zinc is the major strengthening element), between 20% and 40% of the strength is lost when nickel is added. In contrast, the strength of the magnesium-aluminium ("Mg—Al") and magnesium-yttrium-rare earth (Mg—Y-RE) alloys (Examples 3A and 3B) is maintained. FIG. 3 is a plot showing the absolute proof strength values (MPa) against Ni addition (wt %).

FIG. 4 is a plot of corrosion rate against Ni addition (wt %). For the magnesium-yttrium-rare earth alloys, a line has been drawn through the data points which demonstrates the correlation between corrosion rate and Ni addition for these alloys. This shows that the Magnesium-yttrium rare earth alloy, advantageously can be tailored to achieve a desired specific corrosion rate or range of corrosion rates.

Many modifications and variations of the disclosed subject matter will be apparent to those of ordinary skill in the art in light of the foregoing disclosure. Therefore, it is to be understood that, within the scope of the appended claims, the invention can be practiced otherwise than has been specifically shown and described.

The invention claimed is:

1. A corrodible downhole article comprising a magnesium alloy which comprises 0.4-10 wt % of a corrosion promoting element Ni, 2-8 wt % Y, 0.1-15 wt % of at least one rare earth metal other than Y, and 0-1 wt % Zr, wherein a balance is magnesium and incidental impurities, wherein the corrodible downhole article has a corrosion rate of at least 643 mg/cm$^2$/day in 15% KCl at 93° C. and a 0.2% proof strength of at least 50 MPa when tested using standard tensile test method ASTM B557-10.

2. A corrodible downhole article as claimed in claim 1 having a 0.2% proof strength of at least 150 MPa when tested using standard tensile test method ASTM B557-10.

3. A corrodible downhole article as claimed in claim 1 wherein said magnesium alloy comprises up to 8 wt % Ni.

4. A corrodible downhole article as claimed in claim 1 wherein said at least one rare earth metal other than Y includes 2.0-2.5 wt % Nd.

5. A corrodible downhole article as claimed in claim 1 having a maximum corrosion rate of 15,000 mg/cm$^2$/day in 15% KCl at 93° C.

6. A corrodible downhole article as claimed in claim 1 having a maximum corrosion rate of 1000 mg/cm$^2$/day in 15% KCl at 93° C.

7. A corrodible downhole article as claimed in claim 1 having a maximum corrosion rate of 3000 mg/cm$^2$/day in 15% KCl at 93° C.

8. A corrodible downhole article as claimed in claim 1 having a maximum corrosion rate of 4000 mg/cm$^2$/day in 15% KCl at 93° C.

9. A corrodible downhole article as claimed in claim 1 having a maximum corrosion rate of 5000 mg/cm$^2$/day in 15% KCl at 93° C.

10. A corrodible downhole article as claimed in claim 1 having a maximum corrosion rate of 10,000 mg/cm$^2$/day in 15% KCl at 93° C.

11. A corrodible downhole article as claimed in claim 1, said magnesium alloy consisting essentially of: said Ni, Y, at least one rare earth metal other than Y, Zr, and balance of magnesium and incidental impurities.

12. A corrodible downhole article as claimed in claim 1 which is a downhole tool.

13. A corrodible downhole article as claimed in claim 1 with the proviso that it contains no core shell particles.

14. A corrodible downhole article as claimed in claim 1 with the proviso that it contains no coated magnesium alloy powder.

15. A corrodible downhole article as claimed in claim 1, wherein said magnesium alloy comprises 0.4-5 wt % of corrosion promoting element Ni, 2.0-6.0 wt % Y, and 0.1-5.0 wt % of said at least one rare earth metal other than Y.

16. A corrodible downhole article as claimed in claim 1, wherein said magnesium alloy comprises 0.4-5 wt % of corrosion promoting element Ni, 3.7-4.3 wt % Y, and wherein said at least one rare earth metal other than Y includes 2.0-2.5 wt % Nd.

17. A method for producing a corrodible downhole article as claimed in claim 1, comprising the steps of:

melting and mixing elements to form said magnesium alloy; and casting the magnesium alloy and solidifying to form said corrodible downhole article.

18. A method as claimed in claim 17 wherein said casting of said magnesium alloy is carried out in a mold without application of compression to said magnesium alloy.

* * * * *